United States Patent [19]

Gazzarrini

[11] 4,413,575

[45] Nov. 8, 1983

[54] DEVICE FOR TRIMMING AN EDGE OF A TUBULAR TEXTILE ARTICLE

[75] Inventor: Vinicio Gazzarrini, Florence, Italy

[73] Assignee: Solis S.r.l., Florence, Italy

[21] Appl. No.: 218,911

[22] Filed: Dec. 22, 1980

[30] Foreign Application Priority Data

Dec. 24, 1979 [IT] Italy ..... 9634 A/79

[51] Int. Cl.[3] ..... D05B 21/00; B26D 7/10

[52] U.S. Cl. ..... 112/129; 83/171; 83/175; 83/187

[58] Field of Search ..... 112/129, 122, 124 R; 83/171, 187, 175; 2/243 B, 244; 66/147

[56] References Cited

U.S. PATENT DOCUMENTS

| | | | |
|---|---|---|---|
| 3,738,210 | 6/1973 | Fujio | 83/17 |
| 3,756,174 | 9/1973 | Wenz et al. | 112/129 X |
| 3,926,015 | 12/1976 | Sangiacomo | 66/147 |

FOREIGN PATENT DOCUMENTS

| | | | |
|---|---|---|---|
| 2066141 | 7/1981 | United Kingdom | 83/171 |

*Primary Examiner*—Werner H. Schroeder
*Assistant Examiner*—Andrew M. Falik
*Attorney, Agent, or Firm*—McAulay, Fields, Fisher, Goldstein & Nissen

[57] ABSTRACT

A device for trimming an edge of a tubular article to form a portion of a pantyhose prior to the sewing of a gusset. A support is rotatable about its vertically disposed central axis and cooperates with a mask supported independently of the support and normally stationary. The mask has slots with which trimmers in the form of electrical heating elements cooperate, each of the trimmers being movable independently of the other relative to the mask. The support is rotated relative to the mask and one of the trimmers penetrates and cuts the cloth by heat action and enters one of the slots in the mask so that during continued rotation of the support an edge of the article is trimmed from the remainder by the aforesaid trimmers to remain engaged about the support as an annular band. Rotation of the support is then stopped and the other trimmer is extended towards the mask to penetrate the annular band and enter the other slot to sever the annular band by heat action and convert the band into an elongate ribbon which is then drawn off into a suction duct having a mouth mounted for movement with the other trimmer.

17 Claims, 3 Drawing Figures

DEVICE FOR TRIMMING AN EDGE OF A TUBULAR TEXTILE ARTICLE

This invention relates to a device for trimming an edge of a tubular textile article, and in particular for the ease of application of a gusset.

CROSS-REFERENCE TO RELATED APPLICATION

This invention is related to my copending U.S. patent application Ser. No. 107,426 filed on Dec. 26, 1979 which is based on Italian Patent Application No. 9311 A/79 filed Jan. 9, 1979.

My co-pending application No. 107,426, discloses a machine for attaching a gusset to pantyhose or ladies' tights, which includes a hollow frusto-conical support adapted to hold and stretch the non-sewn crotch region while the rest of the article is retained in inside-out attitude inside the support. Below this support, a plate is adapted to bring the gusset opposite the unsewn edge of the article, after which a mechanical cloth cutter trims the cloth of the manufactured article and of the gusset so as to remove parts projecting from the sewing line, all during a complete rotation of the support (i.e. a line along which a seam is sewn or is to be sewn to stitch the gusset to the remainder of the garment).

BACKGROUND OF THE INVENTION

FIELD OF THE INVENTION

The invention relates to a device for trimming an edge of a tubular textile article. More particularly, the invention is concerned with the trimming of the non-sewn edge of a tubular article prior to sewing of a gusset, in a machine for attaching such a gusset during the manufacture of ladies' pantyhose.

DESCRIPTION OF THE PRIOR ART

Experience has shown, especially with some types of fabric, that the beginning of the cutting operation is critical for the cloth cutter and the cutting operation. An additional factor is that the width of the fabric border of the article extending from the stitch line after the cut is not always the same, so that the subsequent stitching or sewing is not always uniform as to thickness and consequently is not uniformly resistant to the tensions to which the article must withstand in use.

SUMMARY OF THE INVENTION

The present invention overcomes such problems by providing a device for trimming the unsewn edge of the tubular article for the stitching of a gusset or a path, especially in a machine as described in my copending application Ser. No. 107,426 for applying the patch or gusset to pantyhose.

This result has been achieved in accordance with the invention by adopting the idea of placing a fixed mask before the rotating support of the article which permits in cooperation with an electric resistance, the precise trimming of the border of the fabric which must of necessity exceed the stitch line.

More specifically, according to the invention, a device is provided for trimming an edge of a tubular textile article, comprising a support providing a frusto-conical peripheral surface, the support being rotatable about the axis of the frusto-conical surface; a curved mask of laminar form, concentric with but spaced radially outwardly from the frusto-conical surface; a first and a second electrically heatable cloth trimming element each mounted for movement, independently of the other, relative to the mask, the arrangement being such that the first and second cloth trimming elements can be disposed in respective positions spaced from the mask and support and an edge portion, to be trimmed, of a tubular textile article which can be stretched over the support and the mask, to encompass both the support and the mask; and the support can be rotated about its axis relative to the mask to traverse the cloth of the textile article over the mask; the first trimming element being extendible towards the mask to penetrate the cloth by the action of heat and enter a first slot in the mask, so that during continued rotation of the support, the portion of the textile article adjacent the edge thereof is trimmed from the remainder by the first trimming element, to remain engaged about the support as an annular band; and after rotation of the support has been stopped, the second trimming element being extendible towards the mask to penetrate the annular band, and enter a second slot in the mask, thereby to sever the annular band by the action of heat to convert the band into an elongate ribbon, and a suction duct having an inlet through which the ribbon formed after severing of the band by the second trimming element can be drawn by suction to remove the ribbon.

Other objects, advantages and the nature of the invention will become readily apparent from the detailed description of the invention in connection with the accompanying drawings.

DESCRIPTION OF THE PREFERRED EMBODIMENTS

Figure 1:
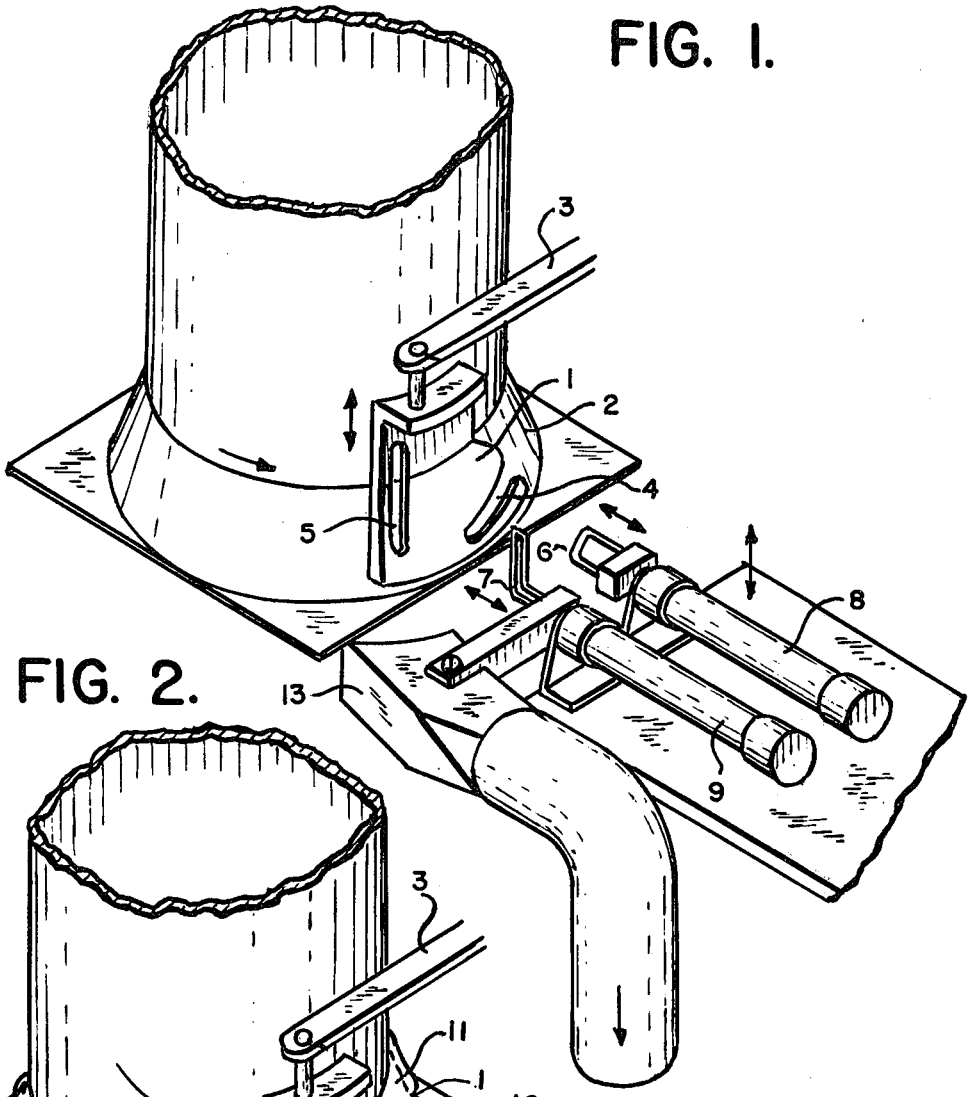
FIG. 1 is a perspective view of a device according to the invention in one position thereof.

In the drawings shown, there is a device, reduced to its essential structure in accordance with the best mode for carrying out the invention for trimming the non-sewn edge of a tubular textile article before sewing on a patch or a gusset to ladies' tights or pantyhose.

The device comprises a hollow annular article support 2, the lower end of which is frusto-conical about a vertical axis, flaring radially outwardly towards the open lower end of the support. The edge of the support forming the lower end is circular and lies in a plane perpendicular to the axis of the support. Above the lower, frusto-conical end, the support is substantially cylindrical about the axis.

A mask 1 is disposed adjacent to but spaced radially outwardly from the peripheral surface of the support 2, and the mask is supported independently of the support by an arm 3. The mask 1 is held in a fixed position relative to the arm 3 and is preferably in the form of a plate or shell or substantially uniform thickness presenting one major surface facing towards the support 2 but spaced substantially uniformly radially from the opposing surface of the support 2 over the area of the major surface, and an opposite major surface facing outwardly away from the support 2. The mask 1 comprises a lower portion adjoining the frusto-conical portion of support 2 which is of complementary frusto-conical form, and an upper portion adjoining the cylindrical part of the support 2 which is of complementary cylindrical form. The surface of the mask 1 is advantageously in the form of a conical shell or pod with the lower base substantially tangential to the support 2.

The lower edge of the mask 1 may be arcuate about the axis of the support 2 and lie in a plane perpendicular to the axis, and the base of the mask 1 may be substantially at a tangent to the support 2.

Mask 1 has two slots 4 and 5 therethrough. Slot 4 is parallel to the bottom or base of the support 2, i.e. extending in a plane parallel with that of the bottom of support 2, and slot 5 is perpendicular thereto, i.e. lying in a vertical plane including the axis of support 2.

Mask 1 normally remains stationary in the machine, while the support 2 is mounted for rotation relative to mask 1 about the vertical axis of support 2 in the sense indicated by the curved arrow in FIG. 1. Mask 1 is vertically movable as indicated by the two-headed vertical arrow on support 2 in FIG. 1.

Figure 2:
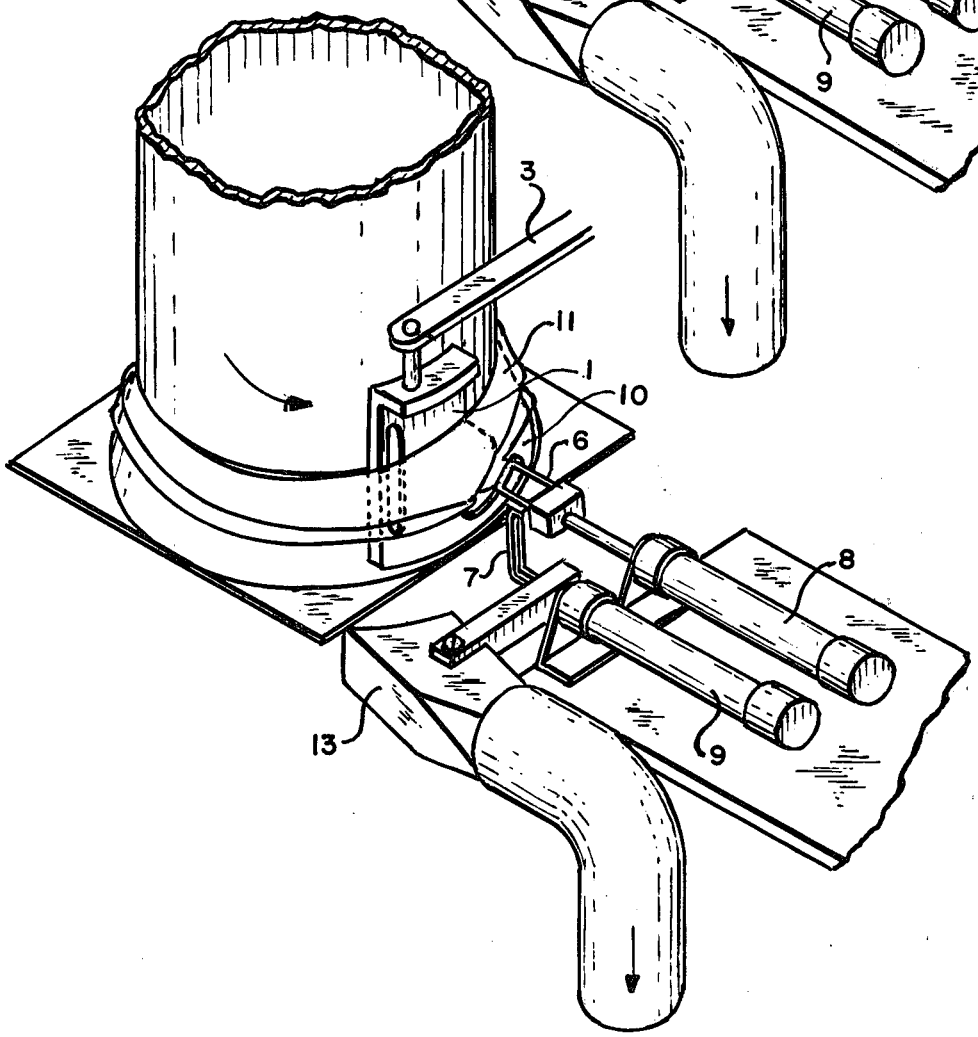
FIG. 2 is a view similar to FIG. 1 but showing the position of the device during a cloth-trimming step; and, FIG. 3 is a view similar to FIGS. 1 and 2 but showing the position of the device during the step when the trimmed cut-off portion is being removed.
Figure 3:
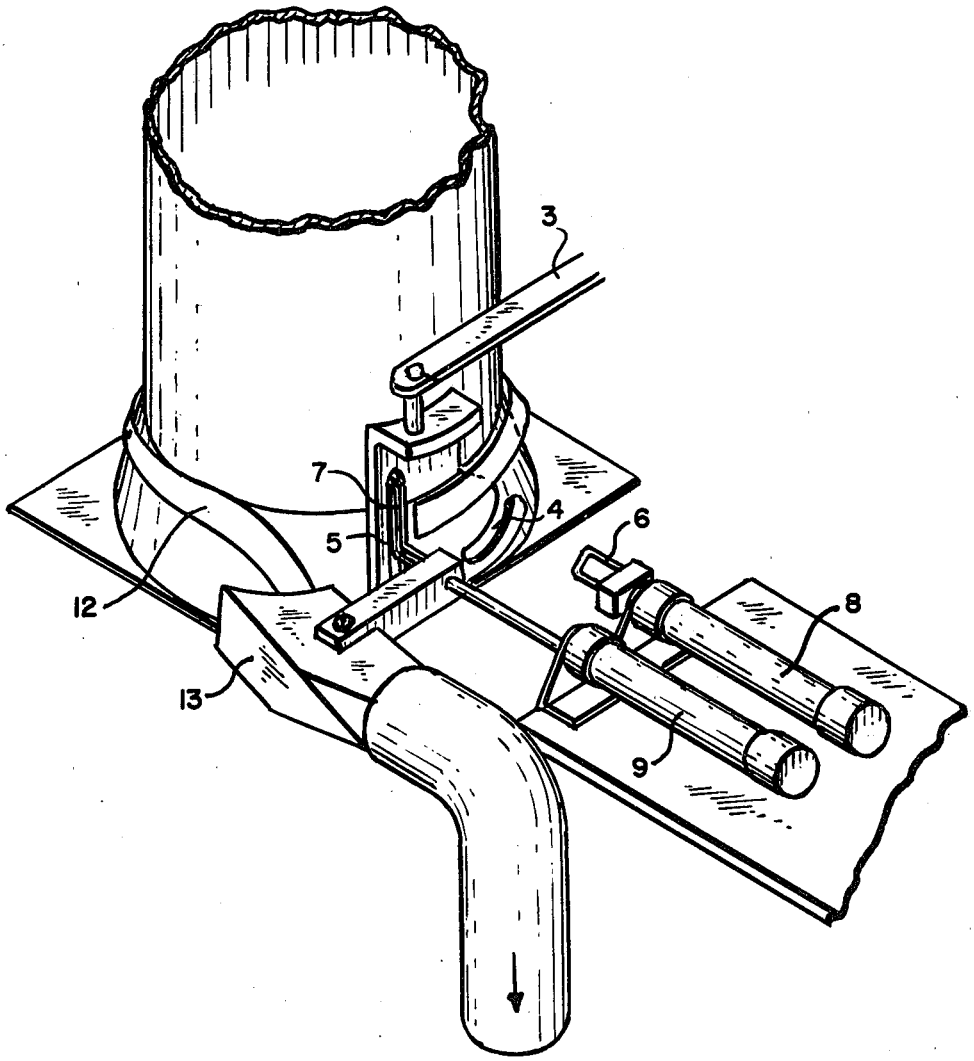

Two trimming elements 6 and 7 are mounted on a common supporting member also normally remains stationary in the machine. Trimming elements 6 and 7 are electrical resistances which are independent and separate from mask 1. Trimming elements 6 and 7 are mounted opposite the mask 1 and are movable independently of one another relative to the common supporting member by means of respective pneumatic actuating elements 8 and 9. Element 6 is so movable between a retracted position as shown in FIG. 1, in which it is spaced substantially from the mask 1 and an extended position as shown in FIG. 2, in which it extends through the slot 4; and element 7 is also movable between a retracted position as shown in FIG. 1 in which it is spaced substantially from the support 2 and mask 1 and an extended position as shown in FIG. 2, in which it extends through the slot 7. Elements 6 and 7 are movable in a to and fro direction as shown by the two-headed horizontal arrow adjacent to, to the right of element 6 and the two-headed arrow adjacent to, to the left of the element 7; both elements 6 and 7 are also vertically movable as shown by the two-headed arrow in FIG. 1 adjacent to element 6.

Trimming elements 6 and 7 are each shown in the form of a loop and formed of electrically resistive wire. The apparatus includes conventional means (not shown), for passing electrical current through each loop to heat the same so that the loop can sever the fabric or cloth 10 to be trimmed by the action of heat, for example by melting the fibers of the cloth or by piercing thereof.

Trimming element or electric resistance 6 is intended for insertion into slot 4 of mask 1 with the effect of piercing the fabric 10 of the article which was previously stretched over support 2 with the interposition of the mask 1 and then making a continuous circumferential cut in the fabric 10 during the combined horizontal rotation of the support 2 and with the effect of detaching, after one complete revolution of the support 2, an annular piece of fabric 11. Trimming element or electric resistance 7 is intended for insertion into slot 5 of mask 1 after electric resistance 6 has detached annular piece 11, with the effect of cutting the piece 11 left superposed on the mask 1 crosswise so that once the ribbon 12 is open, it is easily removable by means of a suction device having a suction mouth 13 which is brought close to electric resistance 7.

Mask 1 and the group of electric resistances 6 and 7 are advantageously displaceable or adjustable vertically by known or conventional means relative to the base of the support 2 to obtain a distance variable at will in accordance with slot 5 from the lower edge of the support 2 and thus to obtain a height variable at will of the border or strip of fabric exceeding or projecting from the stitch or sewing line.

MODE OF OPERATION

The unsewn edge of the article is stretched by hand over the truncated cone-shaped support 2 and over the mask 1 while both are stationary. The article is sucked or drawn into the support 2 to prepare the fabric at the base of the support to sew and to place a gusset onto it.

The trimming elements 6 and 7 are withdrawn from the support 2 and mask 1, when the non-sewn edge portion of the textile article to be trimmed is stretched by hand over the frusto-conical support 2 and on the mask 1, while both are stationary, so as to encompass the support 2 and mask 1 together. Next, the remainder of the article which, as explained in our aforesaid copending application would otherwise hang downwardly, is drawn upwardly by suction into the interior of the support 2 in order to dispose the cloth for sewing opposite the base of the support and place a gusset alongside. Next, trimming element 6 is advanced towards mask 1 until it penetrates the cloth of the tubular article to enter slot 4, and support 2 is rotated about its axis so that the tubular portion of cloth around support 2 and mask 1 is caused to traverse circumferentially over the stationary mask 1 and pass the element 6, so that the trimming element 6 trims the cloth 10 by a continuous circumferential cut. As a result, after a complete rotation of support 2, an annular portion 11 of cloth is separated from the cloth 10. At this stage, trimming element 6 is returned to its withdrawn inoperative position and the support 2 is stopped. Support 2 remains stationary while element 7 is advanced towards mask 1 until it enters slot 5 and in doing so, severs, by the action of heat, the annular band of cloth 11 and thereby opens the band out into ribbon 12.

Secured to element 7 so as to be movable therewith is the suction device in the form of a tubular member providing the inlet to a suction duct, extending to a suction source (not shown), the suction mouth 13 being adjacent to resistance element 7 and facing towards support 2. When band 11 is severed by resistance element 7, resulting ribbon 12 is readily drawn into suction mouth 13 and the suction duct via the inlet and thus removed from the vicinity of support 2. Finally, the suction mouth 13 swallows the ribbon and the electric resistor 7 returns to the inoperative position.

The height of the strip of cloth projecting beyond the sewing line is variable, as noted heretofore because mask 1 and the group of electric resistors 6 and 7 are advantageously vertically adjustable as a whole relative distance between slot 4 and resistance element 6 and the bottom edge of support 2.

While there has been shown and described what is considered to be the preferred embodiment of the invention, it will be obvious to those skilled in the art that various changes and modifications may be made therein without departing from the scope of the invention.

I claim:

1. Device for trimming the unsewn edge of a tubular article, such as a pantyhose, prior to the sewing of a gusset thereon, comprising an article support having a truncated cone shape for stretching the unsewn edge of the article, said support being rotatable in a horizontal direction;

a mask in the form of a shell concentric to a portion of said support fastened independently of said support but spaced a short distance therefrom for underlying the article when the article is in a position stretched over said support and for holding raised a piece of fabric which is to be trimmed from said annular support during the horizontal rotation of said support, said support having a first slot and a second slot;

two electric resistances, each separately introducible into said first and said second slots, one of said resistances cooperating with said first slot to achieve with the simultaneous horizontal rotation of said support the circumferential trimming of the fabric stretched thereon, and said other resistance cooperating with said second slot to achieve with said support in its stationary condition an opening in ribbon form of the annular piece of fabric detached by the aforesaid trimming; and a suction mouth for the removal of the piece of fabric formed into a ribbon.

2. Device according to claim 1 wherein said first slot is parallel to the base of said support and is open at one end; and said second slot is perpendicular and in a withdrawn position in the direction of forward movement of said support relative to said first slot.

3. Device according to claim 1, wherein said suction mouth is placed at a short distance from other electric resistance and traversing therewith to assure the recovery of the piece of fabric reduced to the ribbon.

4. Device according to claim 1, whereby said mask is displaced vertically to vary the distance of said first slot from the base of said support and thereby to vary the height of the piece of fabric exceeding the stitch line after is has been trimmed.

5. Device according to claim 2, whereby said mask is displaced vertically to vary the distance of said first slot from the base of said support and thereby to vary the height of the piece of fabric exceeding the stitch line after it has been trimmed.

6. A device for trimming an edge of a tubular textile article, comprising a support providing a frusto-conical peripheral surface, said support being rotatable about the axis of said frusto-conical surface;

a curved mask of laminar form concentric with but spaced radially outwardly from said frusto-conical surface, said mask having first and second slots;

a first and a second electrically heatable cloth trimming element each mounted for movement independently of the other relative to said mask, the arrangement being such that said first and said second cloth trimming elements can be disposed in respective positions spaced from said mask and support and an edge portion, to be trimmed, of a tubular textile article can be stretched over said support and said mask, to encompass both said support and said mask;

said support being rotatable about its axis relative to said mask to traverse the cloth of the textile article over said mask, and said first trimming element being extendible towards said mask to penetrate the cloth by the action of heat and enter said first slot in the mask so that during continued rotation of said support, the portion of the textile article adjacent the edge thereof is trimmed from the remainder by said first trimming element to remain engaged about the support as an annular band, and after rotation of said support has been stopped, said second trimming element being extendible towards said mask to penetrate said annular band and enter said second slot in said mask, thereby to sever the annular band by the action of heat to convert the band into an elongate ribbon; and a suction duct having an inlet through which the ribbon formed after severing of the band by the said second trimming element is drawn by suction to remove the ribbon.

7. A device according to claim 6, in which said first slot is elongate in a circumferential direction relative to said support and is open at one end, and said second slot is elongate in a plane including the axis of the support and is thus substantially perpendicular to said first slot.

8. A device according to claim 7, wherein said second slot is disposed to precede said first slot in the rotational direction of said support relative to said mask, and said second slot is in a rear position in the direction of advance of said support and has its bottom end in a position such as not to engage the strip of cloth which is subsequently to be sewn.

9. A device according to claim 6 wherein said mask and said trimming elements are mounted for movement parallel with the rotational axis of said support, whereby the height of the strip of cloth projecting from the sewing line in the article after trimming can be varied.

10. A device according to claim 6 wherein said trimming elements are mounted on a common supporting member which in turn is mounted for adjustment of its position relative to said support, in directions parallel with the axis of said support, and each said trimming element is movable independently of the other relative to said common supporting member towards and away from said support in a direction perpendicular to the direction in which the axis of the support extends, by means of a respective actuating element.

11. A device according to claim 10 wherein each said actuating element is a pneumatic device.

12. A device according to claim 9, including a member for the inlet to said suction duct disposed adjacent to said second trimming element and mounted for movement therewith so that said inlet is advanced towards said support with the second trimming element to draw off the elongate ribbon formed by severing of said annular band by said second trimming element.

13. A device according to claim 10, wherein each said trimming element is in the form of a loop of electrically resistive wire, and said device includes means for passing an electrical current through said loop of wire to heat the same by electrical resistance heating.

14. A device according to claim 6 including a pneumatic device for each said trimming element.

15. A device according to claim 6, including a member supporting said suction duct disposed adjacent to said second trimming element and mounted for movement therewith so that said inlet is advanced towards said support with the second trimming element to draw off the elongate ribbon formed by severing of said annular band by said second trimming element.

16. A device according to claim 6, wherein each said trimming element is in the form of a loop of electrically resistive wire.

17. Device according to claim 1, including pneumatic control means for each of said electric resistances for movement thereof horizontally.

* * * * *